US005156424A

United States Patent [19]

Nakamura et al.

[11] Patent Number: 5,156,424

[45] Date of Patent: Oct. 20, 1992

[54] VEHICULAR LOCK DEVICE

[75] Inventors: Shuji Nakamura; Atsuo Suzuki, both of Nirasaki; Takahiro Hisaminato, Wako, all of Japan

[73] Assignees: Mitsui Kinzoku Kogyo Kabushiki Kaisha; Honda Giden Kogyo Kabushiki Kaisha, both of Tokyo, Japan

[21] Appl. No.: 761,142

[22] Filed: Sep. 17, 1991

[30] Foreign Application Priority Data

Sep. 17, 1990 [JP] Japan ..... 2-246804

[51] Int. Cl.[5] ..... E05C 3/26

[52] U.S. Cl. ..... 292/52; 292/216; 292/DIG. 5

[58] Field of Search ..... 292/52, 216, DIG. 5, 292/DIG. 71, 48, 280, 216; 296/224, 76

[56] References Cited

U.S. PATENT DOCUMENTS 4,503,583 3/1985 Frohbieter ..... 292/52 X
4,913,486 4/1990 Staley et al. ..... 292/DIG. 5 X
5,031,949 7/1991 Sorimachi et al. ..... 296/76

*Primary Examiner*—Richard E. Moore
*Attorney, Agent, or Firm*—Browdy and Neimark

[57] ABSTRACT

A vehicular lock device comprises a main latch engageable with a main striker and rotatable, a main ratchet engageable with the main latch in order to keep an engagement relation between the main latch and the main striker, a subsidiary latch adapted to engage with a subsidiary striker and rotate, a subsidiary ratchet adapted to engage with the subsidiary latch in order to sustain an engagement relation of the subsidiary latch with the subsidiary striker, and a rotation lever engageable with the main latch and rotatable correspondingly to rotation of the main latch. Both the latches, both the ratchets, and the rotation lever, respectively are journalled rotatably to the same body of the lock device. When the latch engages with the main striker and the former rotates, the rotation lever rotates so as to make the subsidiary ratchet released from the subsidiary latch. When the subsidiary latch engages with the subsidiary striker, the subsidiary latch rotates the main ratchet so as to make it disengaged from the main latch.

6 Claims, 3 Drawing Sheets

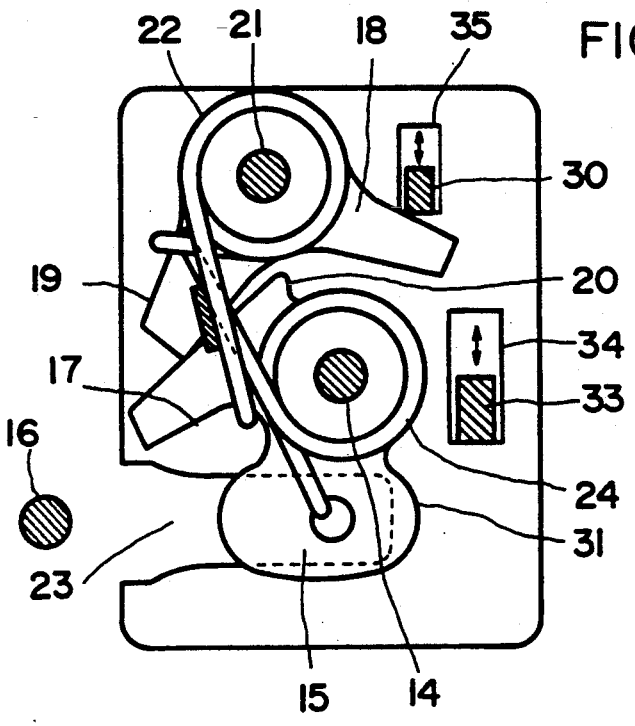
FIG.2
FIG.3
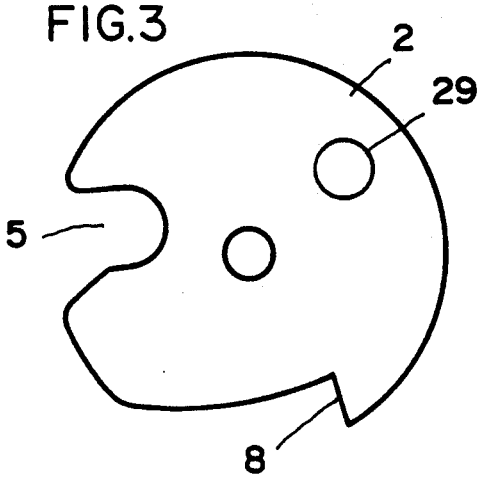
FIG.4
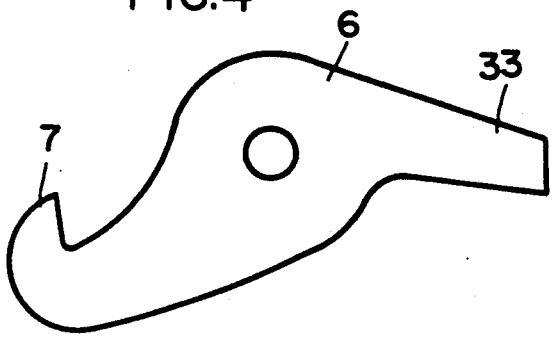

VEHICULAR LOCK DEVICE

FIELD OF THE INVENTION

The present invention relates to a vehicular lock device comprising a main latch engaging with a main striker and a subsidiary latch engaging with a subsidiary striker.

BACKGROUND OF THE INVENTION

Nowadays, various kinds of roof panels removably attached to a ceiling and the like of vehicles have been proposed. There are two kinds of such roof panels; one is swingable or slidable between its closed position closing an opening of the ceiling and its open position opening the opening, and the other is removed or detached from the ceiling in order to open the opening and then stored in a trunk lid (for example, see U.S. Pat. No. 5,031,949).

SUMMARY OF THE INVENTION

According to the present invention, a novel lock device is provided suitable to be employed in a removable member (for example, a removable roof panel) adapted to be securely mounted on a main storing portion or place (for example, an opening of a ceiling of a vehicle) or a subsidiary storing portion or place (for example, a trunk lid). The lock device of the present invention is suitable for use with a roof panel intended for such alternative storage. When the removable member is stored in the main storing portion, it is separated from the subsidiary storing member or the former is released from the latter, and then the removable member is connected to the main storing member. On the contrary, when the removable member is stored in the subsidiary storing portion, the removable member is released from the main storing member, as well as the removable member is connected to the subsidiary member.

Accordingly, it is the purpose of the present invention to provide such novel lock device useful in the vehicles and the like.

An embodiment of the present invention will be explained in detail with reference to the accompanying drawing; of which, FIG. 1 is a front view of the lock device according to the present invention.

FIG. 2 is a section taken along line II—II in FIG. 1.

FIG. 3 is a plan view of a main latch.

FIG. 4 is a plan view of the main latch, also.

DETAILED EXPLANATION OF THE INVENTION

Figure 1:
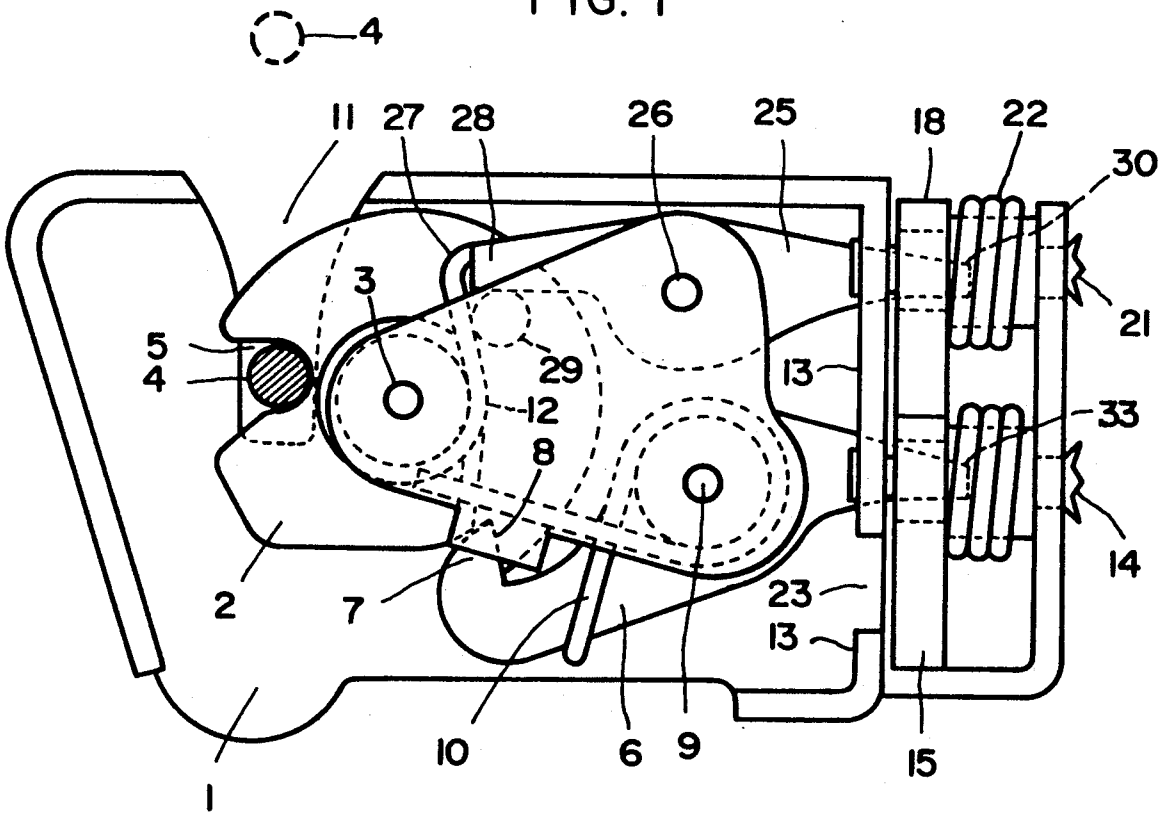
Figure 5:
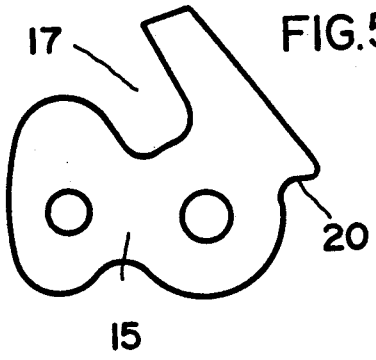
FIG. 5 is a plan view of a subsidiary latch.
Figure 6:
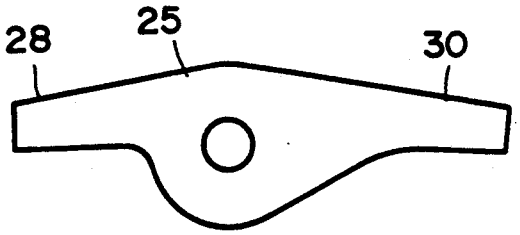
FIG. 6 is a plan view of a subsidiary ratchet.
Figure 7:
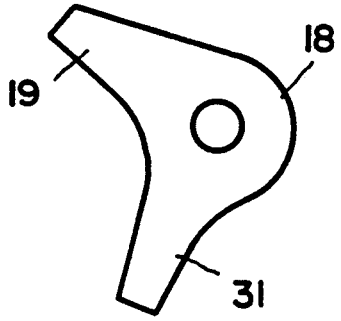
FIG. 7 is a plan view of a rotation lever.

Describing an embodiment of the vehicular lock device according to the present invention with reference to the accompanying drawings, the main latch 2 is rotatably journalled to a metal body of the lock device through a shaft 3. The main latch 2 has an engagement groove 5 adapted to be engaged with the main striker 4 secured in a main storing portion (for example, a space formed in a ceiling of a vehicle) and a stepped portion 8 to be engaged with a claw 7 of the main ratchet 6, respectively formed in an outer peripheral portion of the main latch 2.

The main ratchet 6 is rotatably journalled to the body 1 by means of a shaft 9. The main ratchet 6 is spring-biased to make claw 7 engage the stepped portion 8 by means of a spring 10. The body 1 has a groove 11 through which the main striker 4 is inserted. A spring 12 shown in FIG. 1 urges the main latch 2 to rotate clockwise.

As shown in FIGS. 1 and 2, a subsidiary latch 15 is journalled by means of a shaft 14 to a vertical attachment portion 13 bent at a right angle and formed on a side portion of the body 1. The subsidiary latch 15 has an engagement groove 17 to be engaged with a subsidiary striker 16 secured to a subsidiary storing portion (for example, trunk lid) and a stepped portion 20 with which a claw 19 of the subsidiary ratchet 18 is engaged, both groove 17 and stepped portion being formed thereon.

The subsidiary ratchet 18 is journalled to the vertical attachment portion 13 through a shaft 21. The claw 19 is adapted to be spring-biased to make the stepped portion 20 engage with the claw. A reference numeral 23 shows a groove through which a subsidiary striker 16 formed in the vertical attachment portion 13 is inserted. As shown in FIG. 2, spring 24 biases the subsidiary ratchet 18 clockwise.

An end portion 33 of the main ratchet 6 protrudes sidewise through a window 34 of the vertical attachment portion 13. When the subsidiary latch 15 rotates to its locked position, an end portion 31 of the subsidiary latch 15 is made engaged with the end portion 33 so as to raise on FIG. 2. Consequently, when the main latch 2 and the main striker 4 are engaged to each other, the subsidiary latch 15 engages with the subsidiary striker 16, the rotating subsidiary latch 15 presses the end portion 33 through the end portion 31 so as to rotate the main ratchet 6 clockwise, the claw 7 of the main ratchet 6 is released from the stepped portion 8 of the main latch 2 in order to release the engagement of the main latch 2 and the main striker 4. A rotation lever 25 is placed near the main ratchet 6. The rotation lever 25 is journalled on the body 1 through a shaft 26. An end portion 27 of the spring 12 is engaged with the end portion 28 of the rotation lever 25, so that the end portion 28 is pressed on a pin 29 formed on the main latch 2 through resiliency of the spring 12. Accordingly, due to an engagement between the main latch 2 and the main striker 4, when the former rotates, the rotation lever 25 rotates because the pin 29 engages with the end portion 28.

An end portion 30 of the rotation lever 25 protrudes sidewise through a window 35 formed in the vertical attachment portion 13. The end portion 30 is placed on a rotation track of the end portion 35 of the subsidiary ratchet 18. When the main latch 2 does not engage with the main striker 4 and the subsidiary latch 15 engages with the subsidiary striker 16, the end portion 30 of the rotation lever 25 is moved up in window 35. In this state, when the main latch 2 is engaged with the main striker 4, a rotation of the main latch 2 makes the pin 29 to be engaged with the end portion 28 causing the rotation lever 25 to rotate clockwise on FIG. 1 and the end portion 30 to lower on FIG. 2. The lower position of portion 33 contacts to the end portion 35 of the subsidiary ratchet 18 so as to rotate the subsidiary ratchet 18 clockwise and make the claw 19 released from the stepped portion 20 of the subsidiary latch 15.

An operation of the mechanism of the present invention will be explained.

When the main striker 4 engages with the engagement groove 5 of the main latch 2 so as to rotate the main latch 2, the claw 7 of the main ratchet 6 engages with the stepped portion 8 of the main latch 2 due to resiliency of the spring 10 in order to prevent the main latch 2 from reverse-rotating sustaining the engagement of the main latch 2 and the main striker 4.

Simultaneously, the pin 29 of the main latch 2 pushes the end portion 28 of the rotation lever 25 in order to place the end portion 30 of the rotation lever 25 at the lower position in the window 35. Because the lower position of portion 30 pushes the end portion 35 of the subsidiary ratchet 18 down, the claw 19 of the subsidiary ratchet 18 is placed out of the stepped portion 20 of the subsidiary latch 15. As a result, the subsidiary latch 15 is released from the subsidiary striker 16.

Reversing the operation, when the subsidiary striker 16 is made to engage with the engagement groove 17 of the subsidiary latch 15 the subsidiary latch 15 is rotated counterclockwise, so that the claw 19 of the subsidiary ratchet 18 engages with the stepped portion 20 of the subsidiary latch 15 and accordingly an engagement between the subsidiary latch 15 and the subsidiary striker 16 is kept. Simultaneously, rotation of the subsidiary latch 15 makes a part 35 of the subsidiary latch 15 push the end portion 33 of the main ratchet 6 upward, resulting in a counterclockwise rotation on FIG. 1 of the main ratchet 6, disengagement of the claw 7 from the stepped portion 8 of the main latch 2, and release of the engagement of the main latch 2 from the main striker 4.

As described above, when the main latch 2 of the vehicular lock device of the present invention is in an engaged state, the subsidiary latch 15 is made free, and when the subsidiary latch 15 is in its engaged condition, the main latch 2 is released. Consequently, it is possible to effectively use the lock device according to the present invention when, for example, a roof panel of a vehicle is mounted on and secured to either of the interior space of the ceiling or the trunk lid of the vehicle.

What is claimed is:

1. A vehicle lock device comprising:

a main latch adapted to engage with the main striker and rotate;

a main ratchet adapted to engage with the main latch so as to keep an engagement between said main latch and the main striker;

a subsidiary latch adapted to engage with a subsidiary striker and rotate;

a subsidiary ratchet adapted to engage with said subsidiary latch so as to keep an engagement between said subsidiary latch and the subsidiary striker; and a rotation lever adapted to engage with the main latch and rotate in accordance with rotation of the main latch;

wherein, when the main latch rotates because the main latch engages with said main striker, the rotation lever correspondingly rotates so as to make the subsidiary ratchet disengaged from the subsidiary latch;

when the subsidiary latch engages with the subsidiary striker, the subsidiary latch rotates the main ratchet so as to make the main ratchet disengaged from the main latch.

2. The vehicular lock device according to claim 1, wherein both the latches are rotatably journalled to the same body of the lock device.

3. The vehicular lock device according to claim 2, wherein both the ratchets are rotatably journalled to the same body of the lock device.

4. The vehicular lock device according to claim 3, a rotation lever is rotatably journalled to the same body of the lock device.

5. A vehicular lock device comprising:

a main latch adapted to engage with a main striker and rotate, a subsidiary latch adapted to engage with a subsidiary striker and rotate, engagement means on said main latch and on said subsidiary latch for maintaining said main latch engaged to said main striker and maintaining said subsidiary latch engaged to said subsidiary striker, and release means associated with said engagement means for rotating said subsidiary latch and releasing said subsidiary striker while said main latch and main striker are made to engage and rotating said main latch and releasing said main striker while said subsidiary latch and said subsidiary striker are made to engage.

6. The vehicular lock device according to claim 5, wherein said main latch and said subsidiary latch are rotatably journalled on the same body of the lock device.

* * * * *